United States Patent [19]

Gash et al.

[11] Patent Number: 4,747,642

[45] Date of Patent: May 31, 1988

[54] CONTROL OF SUBSIDENCE DURING UNDERGROUND GASIFICATION OF COAL

[75] Inventors: Bruce W. Gash; Thomas S. Buxton, both of Tulsa, Okla.

[73] Assignee: Amoco Corporation, Chicago, Ill.

[21] Appl. No.: 939,991

[22] Filed: Dec. 10, 1986

Related U.S. Application Data

[63] Continuation of Ser. No. 701,481, Feb. 14, 1985, abandoned.

[51] Int. Cl.[4] ..... E21C 41/00

[52] U.S. Cl. ..... 299/11; 166/256; 166/302

[58] Field of Search ..... 299/11, 19; 166/256, 166/261, 302; 405/266, 267, 288

[56] References Cited

U.S. PATENT DOCUMENTS

| | | | |
|---|---|---|---|
| 3,219,110 | 11/1965 | Martin et al. | 166/256 |
| 3,527,500 | 9/1970 | Thompson | 299/11 |
| 4,067,390 | 1/1978 | Camacho et al. | 166/302 |
| 4,198,097 | 4/1980 | Fondriest | 299/11 |
| 4,213,653 | 7/1980 | Grenia | 299/11 |
| 4,219,237 | 8/1980 | Sisemore | 299/11 |
| 4,289,354 | 9/1981 | Zakiewicz | 299/11 |
| 4,368,921 | 1/1983 | Hutchins | 299/11 |

*Primary Examiner*—Stephen J. Novosad
*Assistant Examiner*—Bruce M. Kisliuk
*Attorney, Agent, or Firm*—Fred E. Hook; Scott H. Brown

[57] ABSTRACT

Disclosed is a process for controlling subsidence during underground gasification of coal. Prior to the complete coal gasification step, holes are provided extending from the bottom to the top of the coal seam and these holes filled with heat resistant support material. Thereafter, the complete gasification process is carried out.

7 Claims, No Drawings

CONTROL OF SUBSIDENCE DURING UNDERGROUND GASIFICATION OF COAL

This a continuation of application Ser. No. 701,481, filed Feb. 14, 1985, now abandoned.

BACKGROUND OF THE INVENTION

This invention relates to the control of subsidence following underground gasification of coal. Underground gasification of coal results in the formation of a cavity where the coal is removed and subsidence or caving of the overburden into the cavity occurs. In some coal gasification facilities, subsidence has occurred all the way to the surface.

Landowners are entitled by law to subjacent support and lateral support. The former is a support which the underlying land gives to the vertically overlying land and lateral support is that which exists on vertical planes dividing the supporting and supported land. Thus, considerable liability can occur as underground mining takes place. Even if there is no subsidence to the surface, other problems exist. Subsidence can result in environmental problems such as aquifer contamination and operational problems including premature loss of wells.

In the more conventional mining of solid fuels such as coal and oil shale, the room and pillar system has been used. This leaves support pillars in place as rooms of the solid fuel are excavated. Suggestions have been made for recovery of the pillars, one example being shown in Sweeney U.S. Pat. No. 4,440,449, (1984) wherein artificial support members are provided between pillars and the pillars thereafter mined.

In underground coal gasification, it is difficult to control the gasification with air or oxygen injection so that pillars of unaffected coal remain to support the overburden.

An object of this invention is to provide a method for supplying support means in a coal seam which is to be mined by underground coal gasification.

A further object is to provide a seam equipped with such support means.

Other objects and advantages of this invention will be apparent to one skilled in the art upon reading this disclosure.

SUMMARY OF THE INVENTION

In one aspect, the invention resides in a method of preparing an underground coal seam having an overburden layer to control subsidence resulting from gasification of coal in said seam comprising drilling a plurality of holes in said coal seam and into the structure below said coal seam, gasifying coal in the vicinity of each hole, thereby producing a plurality of cavities, and filling each cavity with a heat resistant material adapted to support said overburden upon gasification of coal in said seam.

A further aspect of the invention resides in the structure comprising a coal seam located between a lower non-coal layer and an overburden layer resistant to subsidence as a result of gasification thereof containing a plurality of support members of heat resistant material extending between said lower non-coal layer and said overburden.

PREFERRED EMBODIMENTS

As stated above, there are provided support members comprising heat resistant material to support the overburden. For proper support, the holes drilled, into which the heat resistant material is filled, should extend below the bottom of the coal seam. Generally a distance of 5 to 15 feet below said coal seam surface is sufficient. The diameter of the support members will, obviously, vary depending upon the length thereof. Smaller diameter support members are used where the seam is not thick and vice versa. However, in general, the cavities which are to contain the support members are 2 to 5 feet in diameter.

The cavity and resulting support member can be cylindrical but, preferably, is of frustoconical shape.

The preferred resistant material is a cement, this term being broadly used to include concrete by the addition of small aggregate material to the cement. Preferred cements are high-alumina cements manufactured by blending bauxite (aluminum ore) with limestone and heating to a liquid in a reverberatory open hearth furnace. Specific suitable materials including the high alumina cement sold under the name Luminite, by Universal Atlas Cement Company in Gary, Indiana. Another cement of the same type is sold under the name Ciment Fondu, produced in England and France by Lafarge Cement Company. The calcium aluminates produce high early strength and are resistant to high temperatures and attack by corrosive chemicals. Accelerators and retarders can be used to fit individual well conditions as those skilled in the art will recognize. These cements can be used where temperatures in the range of 750° F. to 2000° F. are encountered.

In some operations, cooling of the cement pillars is recommended. This can be done by circulating a cooling medium through pipes installed in place prior to the introduction of the cement. Water is the most convenient cooling fluid although other materials can be used. If a small amount of heat exchange is necessary and the temperature of the support column rises, material such as Dowtherm is suitable.

Thus, it is seen that the invention provides a coal seam resistant to subsidence as a result of gasification of coal.

The initial cavity is produced in the coal seam by using a downhole heater which is lowered into the well and, upon activation, forms a generally cylindrical cavity, the dimensions of which are controlled by raising or lowering the heater. The diameter of the cavity can be controlled by the duration of the gasification with the heater. The growth of the cavity will cease when heat is no longer applied from the heater.

The particular type of heater used does not constitute a feature of the present invention. Simple electrical heaters are suitable as well as combustion systems. One suitable method of producing a hole is shown in Camacho et al., U.S. Pat. No. 4,067,390 (1978). This system uses a plasma arc torch as a heat source for recovering useful fuel products from in situ deposits of coal and the like. This plasma arc torch has the capability of generating heat at various rates. This can range from 3–15 MM BTU/hr.

Location of the pillars will depend upon several factors, which will have to be determined by those developing a particular coal seam. They can be placed in regular arrays to support the overburden as in room and pillar mining or in specific locations. A greater concentration may be desired near a production well. This technique can be used to construct a pillar to support the overburden near the entrance of a slant drilled well into the coal seams.

The present invention has been described with respect to the particular deferred embodiment thereof. Modification and variation will be apparent to those skilled in the art upon reading the disclosure.

I claim:

1. A method of modifying an underground coal seam located between a lower noncoal layer and an overbuden layer to control subsidence resulting from gasification of coal in the underground coal seam, comprising:

(a) drilling a plurality of holes through the overburden layer and the underground coal seam and into the lower noncoal layer, (b) gasifying a portion of the coal adjacent each hole, thereby producing a plurality of cavities of a predetermined shape, (c) placing fluid transportation devices within each cavity;

(d) filling, through the holes, each cavity with a heat resistant material adapted to support the overburden upon gasification of the coal;

(e) introducing a cooling fluid into the transportation devices; and (f) gasifying the coal.

2. The process of claim 1 wherein said holes extent 5 to 15 feet below the bottom of said coal seam.

3. The process of claim 1 wherein each cavity produced by gasification is 2 to 5 feet in diameter.

4. The process of claim 1 wherein each cavity is at large at the base of said seam and narrows toward the top thereof.

5. The process of claim 1 wherein said heat resistant material is a cement.

6. The process of claim 5 wherein said cement is a calcium aluminate cement with a high alumina content.

7. A coal seam located between a lower noncoal layer and an overburden layer modified to be resistant to subsidence in accordance with claim 1.

* * * * *